US007236069B2

(12) United States Patent
Puoskari

(10) Patent No.: US 7,236,069 B2
(45) Date of Patent: Jun. 26, 2007

(54) ADJUSTABLE RESONATOR FILTER

(75) Inventor: Jukka Puoskari, Tupos (FI)

(73) Assignee: Filtronic Comtek OY, Kempele (FI)

( * ) Notice: Subject to any disclaimer, the term of this patent is extended or adjusted under 35 U.S.C. 154(b) by 0 days.

(21) Appl. No.: 11/264,479

(22) Filed: Oct. 31, 2005

(65) Prior Publication Data

US 2006/0071737 A1 Apr. 6, 2006

Related U.S. Application Data

(63) Continuation of application No. PCT/FI05/50170, filed on May 18, 2005.

(30) Foreign Application Priority Data

Jun. 8, 2004 (FI) ..... 20040786

(51) Int. Cl.
*H01P 1/202* (2006.01)
*H01P 1/201* (2006.01)

(52) U.S. Cl. ..... 333/207; 333/202

(58) Field of Classification Search ..... 333/202, 333/207, 219.1, 235, 231–233
See application file for complete search history.

(56) References Cited

U.S. PATENT DOCUMENTS

| | | | | |
|---|---|---|---|---|
| 3,703,689 | A * | 11/1972 | McAtee | 333/223 |
| 3,876,963 | A * | 4/1975 | Graham | 333/202 |
| 4,080,601 | A * | 3/1978 | Alcorn, Jr. | 370/339 |
| 4,186,359 | A * | 1/1980 | Kaegebein | 333/134 |
| 5,184,096 | A * | 2/1993 | Wakino et al. | 333/175 |
| 5,677,654 | A | 10/1997 | Sarkka | |
| 5,949,302 | A | 9/1999 | Sarkka | |

FOREIGN PATENT DOCUMENTS

| | | | |
|---|---|---|---|
| EP | 0 859 422 | A1 | 8/1998 |
| EP | 0 877 433 | A1 | 11/1998 |
| FI | 106584 | B | 8/1998 |
| FI | 104298 | B | 6/1999 |
| FI | 20030402 | | 9/2004 |
| WO | WO-99/30383 | A2 | 6/1999 |

* cited by examiner

*Primary Examiner*—Seungsook Ham
(74) *Attorney, Agent, or Firm*—Darby & Darby

(57) ABSTRACT

An adjustable resonator filter (200), the operating band of which can be shifted by a one-time adjustment. The natural frequency of each resonator (210, 220) is affected, in addition to the basic tuning arrangement, by an adjustment circuit (ACI), which includes a fixed tuning element (280) in the resonator cavity and an adjusting part (290) outside the cavity. The tuning element has an electromagnetic coupling to the basic structure of the resonator. The adjustment circuit is functionally a short transmission line, which is "seen" by the resonator as a reactance of a certain value. By changing the electric length of the transmission line, the value of the reactance and the electric length and natural frequency of the whole resonator are changed. The change is implemented in the adjustment part by means of switches or a movable dielectric piece. In the resonator filter each resonator has a similar adjustment circuit, and the adjustment circuits have common control (CNT) for shifting the band of the filter. When the subband division is in use, the filters need not be separately adjusted for each subband in connection with the manufacture. No moving parts are required inside the filter housing.

12 Claims, 6 Drawing Sheets

ADJUSTABLE RESONATOR FILTER

CROSS REFERENCE TO PRIOR APPLICATION

This application is a continuation of International Patent Application Serial No. PCT/FI2005/50170, filed May 18, 2005, which claims priority of Finnish Application No. 20040786, filed Jun. 8, 2004, both of which are incorporated by reference herein.

The invention relates to a filter consisting of resonators, the operating band of which can be shifted by a one-time adjustment. A typical application of the invention is an antenna filter of a base station.

BACKGROUND OF THE INVENTION

When a resonator filter is manufactured, its transmission characteristics, i.e. its frequency response, must be arranged to comply with the requirements. This requires that the strengths of the couplings between the resonators are correct and that the resonance frequency, or natural frequency, of each resonator has a pre-determined value especially in relation to the natural frequencies of other resonators. In serial production, the variation of the natural frequency of a certain resonator of different filters is generally too wide with regard to the filter requirements. Because of this, each resonator in each filter must be tuned individually. Tuning like this is here called the basic tuning. A very common resonator type in filters is a coaxial quarter-wave resonator, which is shorted at its lower end and open at its upper end. In that case the basic tuning can be performed, for example, by turning the tuning screws on the cover of the filter housing at the inner conductors of the resonators or by bending the protruding parts of the extensions formed at the ends of the inner conductors. In both cases, the capacitance between the inner conductor and the cover changes in each resonator, in which case the electric length and natural frequency of the resonator also change.

When the filter is intended to be part of a system in which a division of the transmitting and receiving bands into subbands is used, the width of the passband of the filter must be the same as the width of a subband. In addition, the passband of the filter must be arranged at the desired subband. In principle, this can take place already at the manufacturing stage in connection with the basic tuning. However, in practice often a certain standard basic tuning only is carried out at the manufacturing stage, and the subband is selected in connection with taking into use by shifting the passband of the filter when required. The passband is shifted by changing the natural frequencies of the resonators by the same amount without touching the couplings between the resonators.

The natural frequencies of the resonators can be changed for shifting the passband by tuning each resonator separately and by watching the response curve. However, such adjustment is time-consuming and relatively expensive, because tuning has to be implemented manually in several iteration steps in order to achieve the desired frequency response. FIG. 1*a,b* presents a resonator filter known by the applicant from the application FI20030402, the passband of which can be shifted by a one-time adjustment. The filter 100 is a six-resonator duplex filter. The cover, bottom, side walls and end walls form a conductive filter housing, the inner space of which has been divided by partition walls into resonator cavities. In FIG. 1*a*, the structure is seen from above as the cover removed. The resonators are coaxial quarter-wave resonators; each of them has an inner conductor, the lower end of which is galvanically coupled to the bottom and the upper end of which is "in the air". The resonators are in two rows of three resonators. The first 110, the second 120 and the third 130 resonator form a transmitting filter, and the fourth 140, the fifth 150 and the sixth 160 resonator form a receiving filter. The third and the fourth resonator are parallel in the 2×3 matrix, and they both have a coupling to the antenna connector ANT. The sixth resonator has a coupling to the receiving connector RXC and the first resonator to the transmitting connector TXC. In the transmitting and receiving filter, there is an electromagnetic coupling between the resonators through openings in the partition walls, for example.

For adjusting the filter, the structure includes a united dielectric tuning piece, which consists of resonator-specific tuning elements, such as the tuning element 128 of the second resonator and the tuning element 148 of the fourth resonator, and an arm part 108. The arm part has the shape of a rectangular letter U; it has a first portion extending from the first to the third resonator, a transverse second portion extending from the third to the fourth resonator, and a third portion extending from the fourth to the sixth resonator. Each resonator-specific tuning element is, in a way, an extension of the arm part of the tuning piece. The united tuning piece can be moved horizontally in the longitudinal direction of the filter back and forth so that the tuning elements move to a position above the inner conductors of the resonators or away from a position above the inner conductors. The moving takes place either through a slot in the cover or an opening at the end of the filter housing on the side of the third and the fourth resonator. When at the left limit of the tuning range, each tuning element is above the inner conductor of the resonator, and when at the right limit of the tuning range, each tuning element is beside the inner conductor of the resonator as viewed from above. In the former case, the effective dielectric coefficient in the upper part of the resonator cavity is at the highest, because the dielectric element is located in a place where the strength of the electric field is at the highest when the structure is resonating. Then the capacitance between the upper end of the inner conductor and the conductive surfaces faces around it is at the highest, the electric length of the resonator at the highest and the natural frequency at the lowest. Correspondingly, when the tuning element is at the right limit of its adjusting range, the natural frequency of the resonator is at the highest.

In FIG. 1*b* the cover 105 of the filter 100 and the tuning piece are seen from the side. The arm part 108 of the tuning piece runs through notches in the upper edge of the partition walls of the resonators, keeping the whole tuning piece against the lower surface of the cover. In the example of the figure, the tuning elements reach deeper into the resonators in the vertical direction than the arm part of the tuning piece. For example, the tuning element 128 of the second resonator extends close to the upper end of the second inner conductor 121, drawn in the figure.

In the filter shown by FIGS. 1*a,b*, both the transmitting and receiving band shift by a one-time adjustment because of the unity of the tuning piece. The structure is relatively compact, but moving the tuning piece requires a bit of mechanism.

SUMMARY OF THE INVENTION

It is an objective of the invention to implement the adjustment of a resonator filter in a new and advantageous manner. A resonator filter according to the invention is characterized in what is set forth in the independent claim 1. Some preferred embodiments of the invention are set forth in the other claims.

The basic idea of the invention is the following: The natural frequency of a resonator is influenced, in addition to the basic tuning arrangement, by an adjustment circuit, which includes a fixed tuning element in the resonator cavity and an adjusting part outside the cavity. The tuning element has an electromagnetic coupling to the basic structure of the resonator. The adjustment circuit is functionally a short transmission line, and so it is "seen" by the resonator as a reactance of a certain value. The electric length of the transmission line is changed by the adjusting part, whereby the value of the reactance is changed, and as a result of this the electric length and the natural frequency of the whole resonator are also changed. The change is implemented in the adjusting part by means of switches or a movable dielectric piece, for example. In the resonator filter each resonator has an equal adjustment circuit, and the adjustment circuits can have common control for shifting the operating band of the filter.

An advantage of the invention is that when the subband division is in use, the filters need not be separately adjusted for each subband in connection with the manufacture, because the selection of the subband can take place when the filter is put into use by a simple adjustment. In addition, the invention has the advantage that the additional losses caused by the adjusting arrangement of the filter are very low. Furthermore, the invention has the advantage that at least inside the resonator cavities no moving parts are required, which means increased reliability. A further advantage of the invention is that when electronic switches are used, the adjusting of the filter can be implemented by simple electric control.

BRIEF DESCRIPTION OF THE DRAWINGS

In the following, the invention will be described in more detail. Reference will be made to the accompanying drawings, in which FIGS. 1*a,b* show a prior art resonator filter, the passband of which can be shifted by a one-time adjustment, FIGS. 2*a,b* present the principle of a resonator filter according to the invention.

DETAILED DESCRIPTION OF THE INVENTION

Figure 1A:
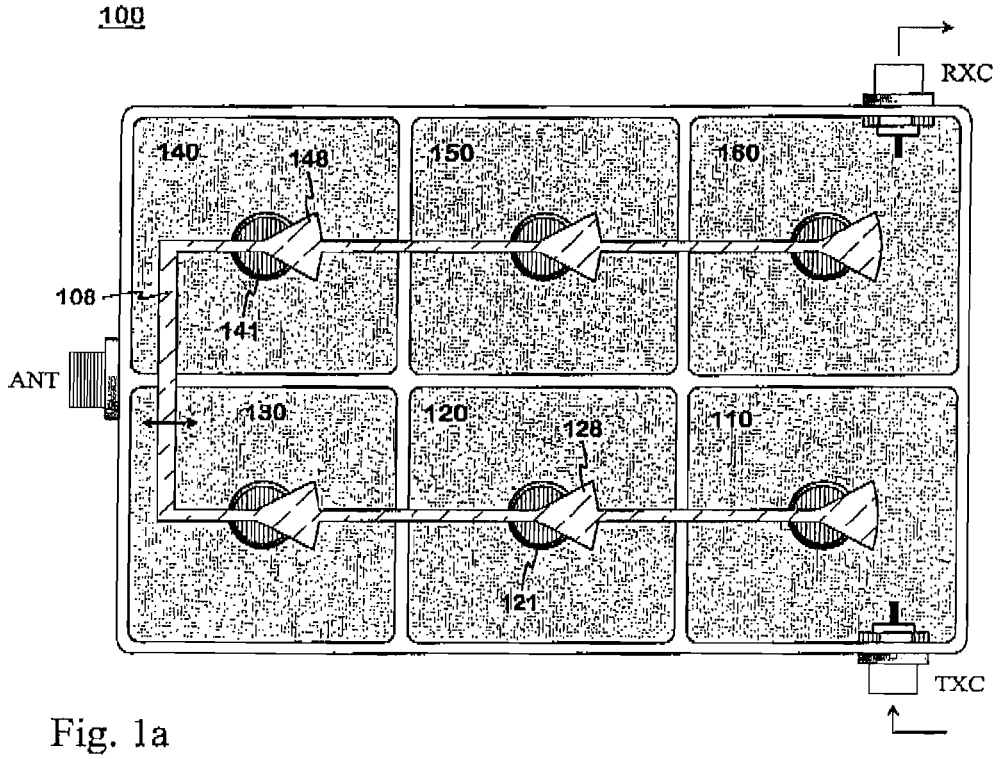
Fig. 1a PRIOR ART
Figure 1B:
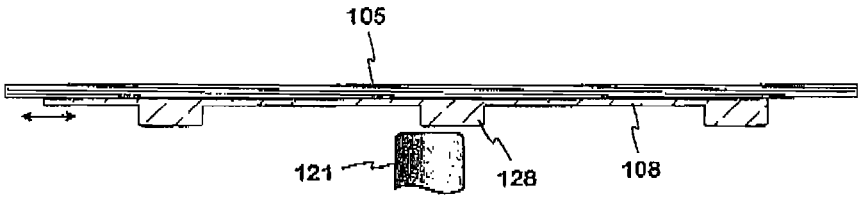
Fig. 1b PRIOR ART

FIGS. 1*a* and 1*b* were already explained in connection with the description of the prior art.

Figure 2A:
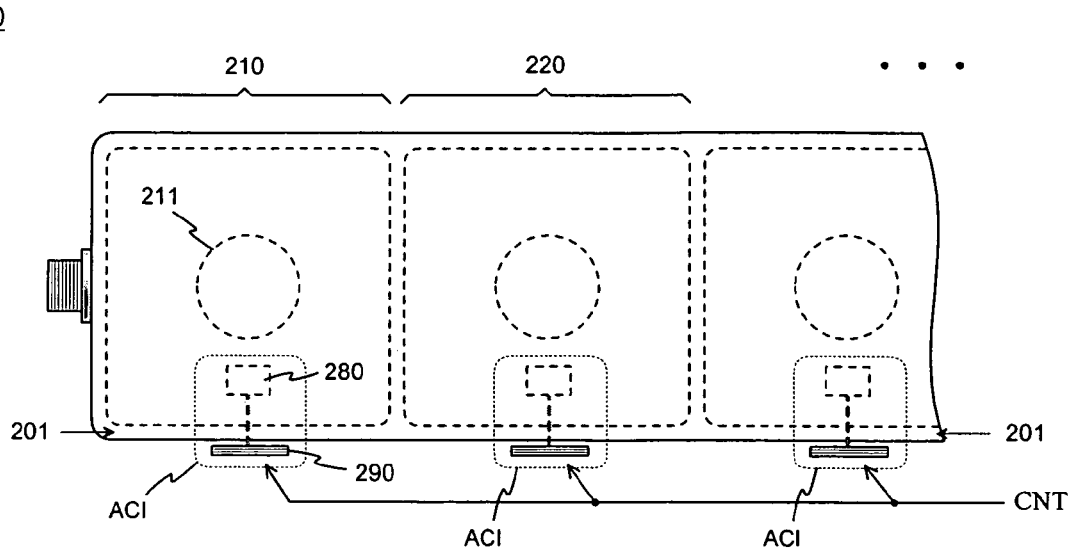

FIG. 2*a* is a structural drawing presenting the principle of a resonator filter according to the invention. The filter 200 is seen in the figure from above when the cover is in place. In it there are in a united and conductive filter housing resonators in succession, such as a first resonator 210 and a second resonator 220. In the cavity of the first resonator there is an element 211 belonging to the basic structure of the resonator, and there is a similar element in the other resonators. Each resonator is equipped with an adjustment circuit ACI, which includes a fixed tuning element 280 and an adjusting part 290. The tuning element is conductive and it is located in the resonator cavity, for which reason it has an electromagnetic coupling to the basic structure of the resonator. The adjusting part 290 is located outside the resonator cavity, in the exemplary drawing beside the side wall 201 of the housing, and it is connected through an opening in the housing to the tuning element 280. To the adjusting part comes a control CNT from outside the filter. The same control also affects the adjusting circuits of other resonators, in which case a change of the control changes the natural frequencies of all resonators by the same amount. Because of this, the operating band of the filter shifts, but the shape of the response curve hardly changes.

Figure 2B:
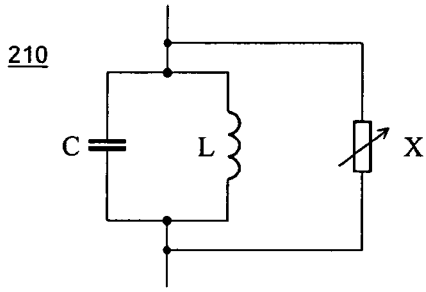

The adjusting part of the adjustment circuit includes a conductor, which together with the housing that functions as the signal ground forms a transmission line shorter than a quarter of the wavelength. If this transmission line is shorted at the opposite end as viewed from the tuning element, the impedance of the line is purely inductive. When the tail end is open, the impedance is purely capacitive. In both cases, the whole adjustment circuit, the tuning element and an intermediate conductor included, represents a reactance of a certain value as viewed from the resonator. An equivalent circuit according to FIG. 2*b* is thus obtained for the filter for the part of one resonator. If the resonators are quarter-wave resonators, their basic structure corresponds at the resonance frequency to a parallel resonance circuit formed by a capacitor C and a coil L. A reactance X formed by the adjustment circuit is coupled parallel with that resonance circuit. If the reactance is capacitive, the effect is that the natural frequency of the resonator becomes lower, if inductive, the effect is that the natural frequency becomes higher. When the electric length of the transmission line is changed, the value of the reactance X changes, and as a result of this the electric length and natural frequency of the whole resonator also change. The resonators can also be half-wave resonators, in which case their equivalent circuit is a serial resonance circuit.

Figure 3:
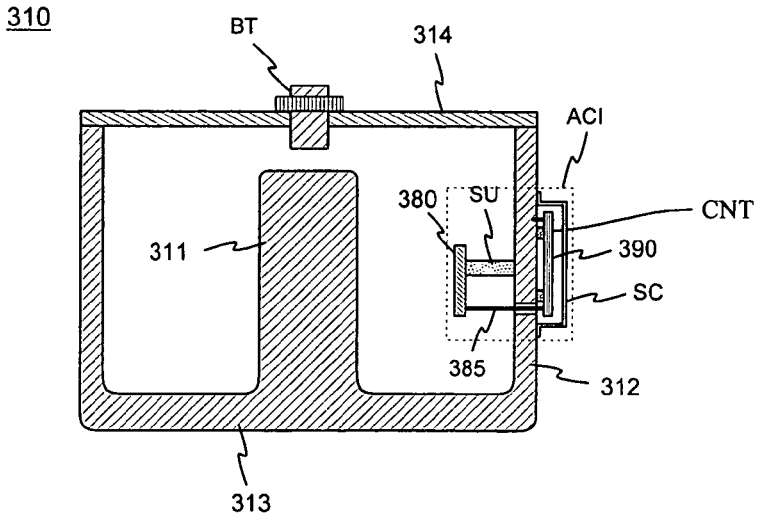
FIG. 3 presents an example of an adjustment circuit according to the invention.

FIG. 3 shows an example of a resonator adjustment circuit according to the invention, which is intended to be part of the whole arrangement for shifting the operating band of the filter. The resonator 310 of the example is a quarter-wave coaxial resonator. This means that there is an inner conductor 311 in its cavity, the lower end of which inner conductor is galvanically joined to the bottom 313 of the resonator, and there is an empty space between the inner conductor's upper end and the cover 314 of the resonator. The adjustment circuit ACI is on the side of a wall 312 belonging to the outer conductor of the resonator, which wall is also part of the other side wall of the whole filter. The tuning element 380 belonging to the adjustment circuit is a conductor piece in the resonator cavity being isolated from the conductors of the resonator. In the vertical direction the tuning element is located about half way of the inner conductor 311. The tuning element is fastened to the wall 312 by a low-loss dielectric support piece SU. Naturally, the fastening could also be to the bottom of the resonator, for example. The adjusting part 390 belonging to the adjustment circuit is a small circuit board close to the outer surface of the wall 312. The conductive part of the circuit board is galvanically coupled to the tuning element by a intermediate conductor 385. The circuit board is covered by a shielding cover SC, which shields the adjustment circuit against external interference fields and prevents the adjusting part from radiating to the environment.

A tuning element BT for the basic tuning of the resonator, fastened to its cover, is also seen in the resonator 310, although it is as such not related to the present invention.

Figure 4:
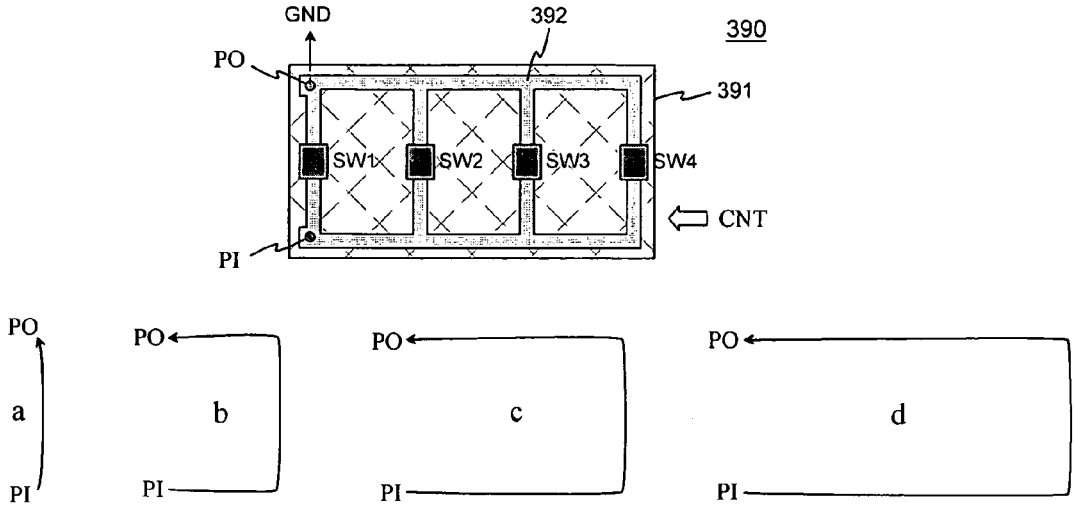
FIG. 4 presents an example of the adjusting part of an adjustment circuit according to FIG. 3.

FIG. 4 shows an example of the adjusting part of the adjustment circuit according to FIG. 3. The adjusting part is formed of a rectangular circuit board 390, which includes a dielectric plate 391, a conductor pattern 392 and four switches. The conductor pattern is connected to the tuning element of the adjustment circuit from a point PI close to a corner on the side of the first end of the circuit board. The point PO of the conductor pattern in the opposite corner of the first end is connected or left unconnected to the signal ground GND. The first switch SW1 is close to the first end of the board, half way of it, the second switch SW2 toward the second end of the board from it, the third switch SW3 further from the second switch toward the second end of the board and the fourth switch SW4 as far as at the second end. The conductor pattern 392 has two symmetrical parts. In the drawing, the lower part comprises a micro strip starting from point PI, running along the first side and the second end of the board and ending at the switch SW4. That part has side branches to the switches SW1, SW2 and SW3. Correspondingly, in the drawing the upper part of the conductor pattern comprises a micro strip starting from point PO, running along the second side and second end of the board and ending at the switch SW4, with side branches to the switches SW1, SW2 and SW3. The switches are, for example, semiconductor switches or MEMS switches (Micro Electro Mechanical System). The micro strips, through which they are controlled, are on the side of the circuit board 390 not visible in FIG. 4. They can naturally also be arranged on the same side with the switches, in which case the conductor pattern 392 is alone on the other side of the board, face to face with the wall of the resonator.

By the control CNT of the adjusting part, one of the switches is kept closed and the others open. When the switch SW1 is closed, the electrical circuit between the points PI and PO is formed through it along a short route a. When the switch SW2 is closed, the electrical circuit between the points PI and PO is formed through it along a longer route b, and when the switch SW3 is closed, along an even longer route c. When the switch SW4 is closed, the electrical circuit is formed along the longest route d, i.e. along three edges of the circuit board. The routes a, b, c and d have been marked as separate lines in FIG. 4.

If the point PO is connected to the signal ground GND, as which the wall of the resonator beside the board functions, the transmission line mentioned in the description of FIG. 2*a* is shorted at the opposite end. If the point PO is left unconnected, the transmission line is open at the opposite end. In both cases, the electric length of the transmission line and the reactance corresponding to it depend, on the basis of what is explained before, on which of the switches of the adjusting part is closed.

Figure 5:
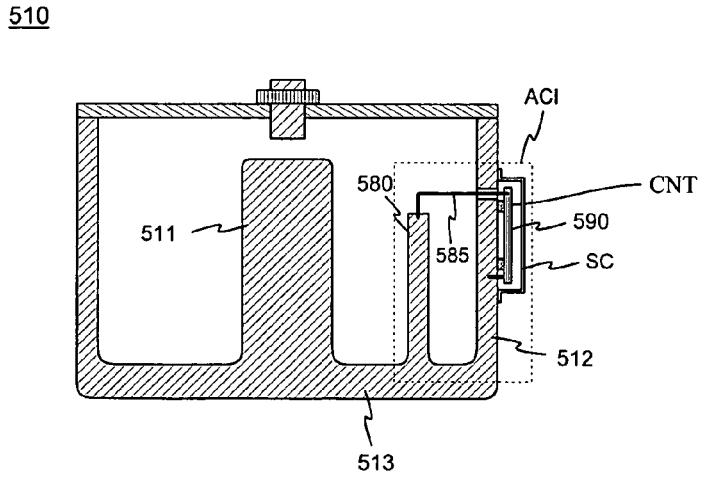
FIG. 5 presents another example of an adjustment circuit according to the invention.

FIG. 5 shows another example of a resonator adjustment circuit according to the invention, which is intended to be part of the whole arrangement for shifting the operating band of the filter. The resonator 510 of the example is a similar quarter-wave coaxial resonator as in FIG. 3 in its basic structure. The adjustment circuit ACI of the resonator is also similar to the one in FIG. 3 with the difference that its tuning element 580 is now a conductor parallel with the inner conductor 511 and galvanically joined to the bottom 513 of the resonator in the space between the inner conductor and the outer conductor 512. Because of such a structure, the electromagnetic coupling of the tuning element to the basic structure of the resonator is predominantly inductive. The upper end of the tuning element is connected to the adjusting part 590 of the adjustment circuit by a intermediate conductor 585. The adjusting part has a protective sheet cover SC, like in FIG. 3.

Figure 6:
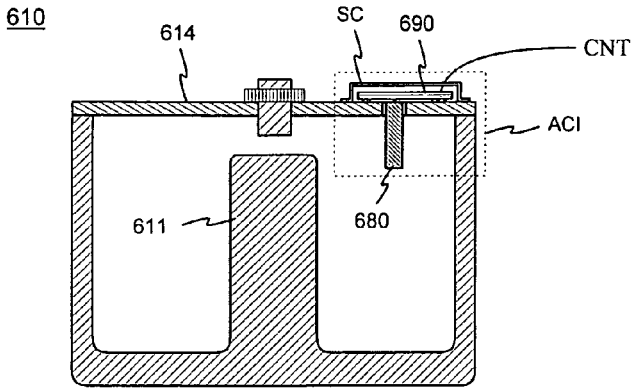
FIG. 6 presents a third example of an adjustment circuit according to the invention.

FIG. 6 shows a third example of a resonator adjustment circuit according to the invention, which is intended to be part of the whole arrangement for shifting the operating band of the filter. The resonator 610 of the example is a similar quarter-wave coaxial resonator as in FIG. 3 in its basic structure. The adjustment circuit ACI of the resonator differs from the one shown in FIG. 3 in that its tuning element 680 is now fastened by an insulating joint to the cover 614 of the resonator. The tuning element is substantially completely at the electrically open upper end of the resonator, and thus the coupling between the tuning element and the basic structure of the resonator is quite purely capacitive at the resonance frequency. The adjusting part 690 of the adjustment circuit is on top of the cover 614 at the tuning element. It is covered by a shielding cover SC.

Figure 7A:
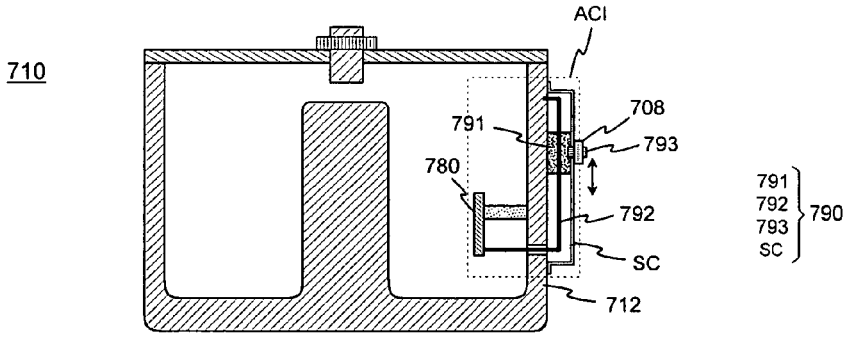
FIG. 7*a* presents a fourth example of an adjustment circuit according to the invention.

FIG. 7*a* shows a fourth example of a resonator adjustment circuit according to the invention, which is intended to be part of the whole arrangement for shifting the operating band of the filter. The resonator 710 of the example is a similar quarter-wave coaxial resonator as in FIG. 3 in its basic structure. The adjustment circuit ACI of the resonator is also similar to the one in FIG. 3 with regard to the tuning element 780, but the adjusting part 790 of the adjustment circuit is now different. The adjusting part includes a rigid conductor 792, a movable dielectric adjusting piece 791 and its extension 793. The shielding cover SC can also be regarded as belonging to the adjusting part. The adjusting piece 791 has a shaping in the direction of its direction of movement, such as a hole or groove, through which the straight portion in the rigid conductor 792 runs. The cross-sectional areas of the shaping and the conductor are equal in size and shape. One side of the adjusting piece can be against the outer surface of the outer conductor 712 of the resonator, and in addition at least one other side can be against the inner surface of the shielding cover SC. The friction on the contact surfaces of the adjusting piece is such that it can be slid along the rigid conductor 792, but the piece remains exactly at the place to which it has been moved. The adjusting of the natural frequency of the resonator is now based on the fact that the reactance of the transmission line formed by the adjustment circuit and the signal ground depends on the place of the dielectric adjusting piece on the transmission line.

Figure 7B:
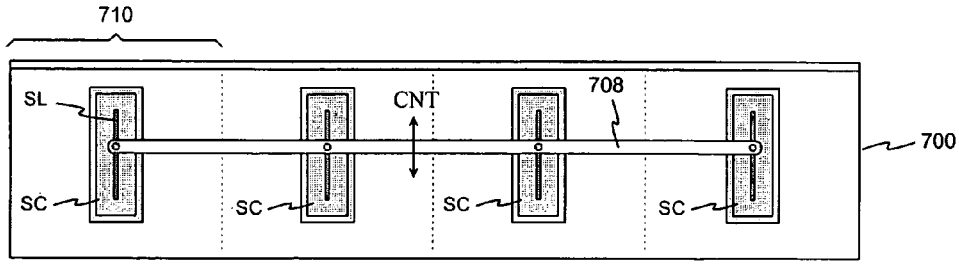
FIG. 7*b* shows an example of using the adjustment circuit according to FIG. 7*a* for shifting the operating band of the filter.

FIG. 7*b* shows an example on how an adjustment circuit according to FIG. 7*a* can be used for shifting the operating band of the filter. The filter 700 of the example comprises a first resonator 710 and three other resonators. For the adjusting, in the shielding cover SC of each adjustment circuit there is a slot SL in the direction of said rigid conductor, vertical in the figure, from which the projection 793 of the adjusting piece sticks out. The projections of the adjustment circuits of different resonators have been connected by a horizontal rod 708. This is also seen in FIG. 7*a* from the end. When the control rod is moved in the vertical direction, the adjusting pieces mechanically connected to it all move an equal distance and the band of the filter is shifted. The moving of the rod can be implemented manually or electrically by some regulating unit, such as a stepping actuator or a device based on piezoelectricity or piezomagnetism.

Figure 8:
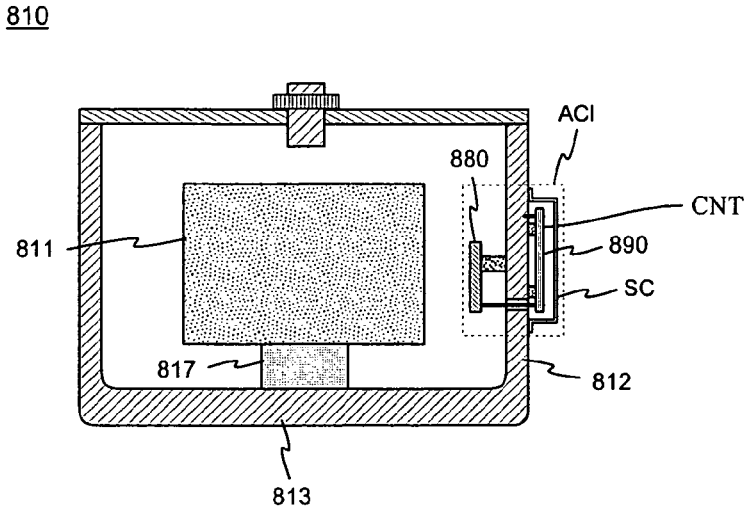
FIG. 8 shows an example of a resonator equipped with an adjustment circuit according to the invention.

FIG. 8 shows an example of a resonator equipped with an adjustment circuit according to the invention. The resonator 810 is now a half-wave dielectric cavity resonator in its basic structure. There is a fixed, cylindrical, dielectric piece 811 in its cavity such that the bases of the piece are parallel with the bottom 813 and cover of the resonator. The dielectric piece has been raised above the bottom by a dielectric support piece 817, the dielectricity of which is substantially lower than that of the dielectric piece 811. The structure has been dimensioned so that a $TE_{01}$ (Transverse Electric) waveform is created in it at the operating frequencies of the filter. The adjustment circuit ACI is similar to the one shown in FIG. 3: The tuning element 880 is operating as the outer conductor of the resonator inside the side wall 812, and the adjusting part 890 is immediately outside the side wall. The adjustment circuit could also be of some other kind, e.g. like the one shown in FIG. 5, 6 or 7*a*. Also in this case, changing the reactance of the adjustment circuit changes the electric size of the resonator and thus its natural frequency.

Figure 9:
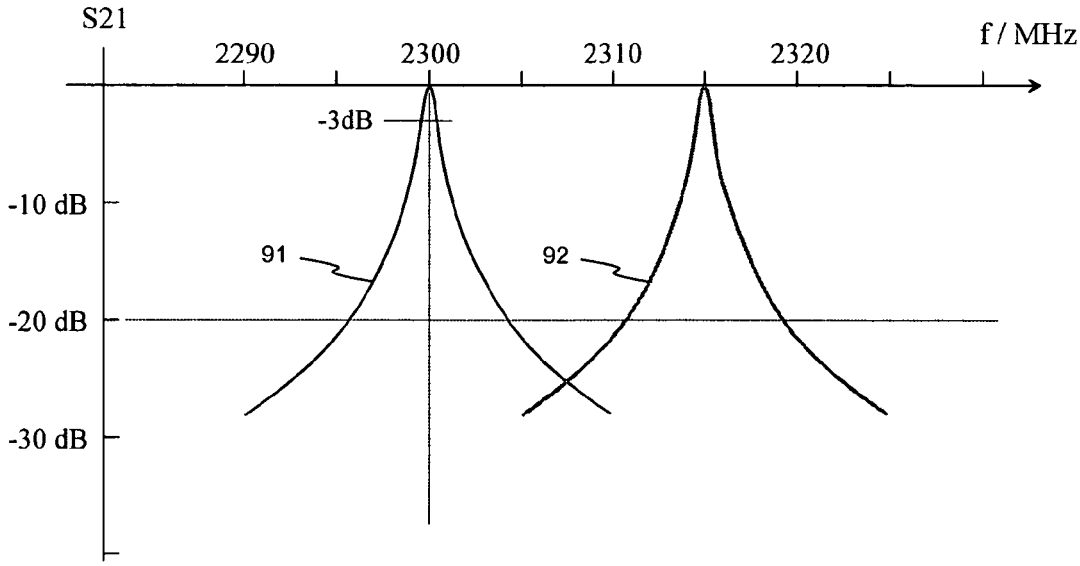
FIG. 9 shows an example of a frequency response and shifting of the natural frequency of a resonator equipped with an adjustment circuit according to the invention.

FIG. 9 shows an example of the frequency response of a resonator equipped with an adjustment circuit according to the invention, and the shifting of the natural frequency. The figure presents the transmission coefficient S21 as a function of frequency, i.e. the amplitude part of the frequency response, in two situations. The first curve 91 shows a situation in which the natural frequency of the resonator is 2300 MHz. The bandwidth as measured at the attenuation 3 dB is about 0.82 MHz, and thus the Q value of the resonator becomes about 2800. The second curve 92 is substantially of the same shape as the first one. Its peak is at 2315 MHz, and thus the shift of the natural frequency of the resonator is 15 MHz. At the frequencies of the example, a quarter of the wavelength is in the order of 3 cm. In that case, it is suitable to change the electric length of the transmission line represented by the adjustment circuit in a range of about 2 cm. This means an adjustment range of about 100 MHz for the natural frequency of the resonator, in practice.

Figure 10:
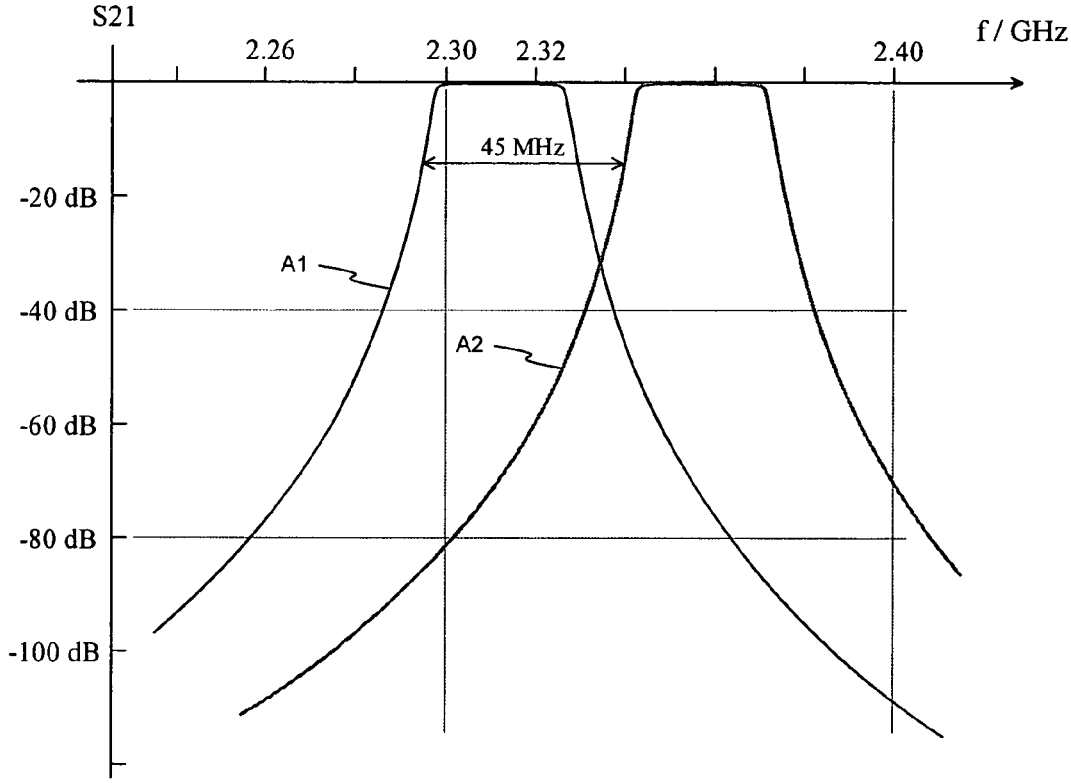
FIG. 10 shows an example of a shifting of the passband of a filter according to the invention.

FIG. 10 shows an example of the shifting of the passband of a filter according to the invention. The filter has five resonators. The figure shows the transmission coefficient S21 as a function of frequency in two situations. The first curve A1 shows a situation in which the passband is about 2298–2326 MHz. The second curve A2 shows a situation in which the passband has shifted about 45 MHz upwards.

The qualifiers "lower", "upper", "from above", "from the side", "horizontal", "vertical" and "height" in this description and the claims refer to a position of the resonators in which their inner and/or outer conductors are vertical and the bottom is the lowest. Thus the qualifiers have nothing to do with the position in which the devices are used.

Above resonator-based filters have been described, the operating band of which can be shifted by a one-time adjusting by means of commonly controlled adjustment circuits. The structure can naturally differ from the ones presented in its details. For example, the conductor pattern of the adjusting part changeable by switches can be shaped in many ways. Such an adjusting part can also be made without a circuit board for reducing losses. The basic structure of the filter can also be made without conductive partition walls, when the distances between the inner conductors are selected suitably. The inventive idea can be applied in different ways within the scope set by the independent claim 1.

The invention claimed is:

1. An adjustable resonator filter, which comprises a plurality of resonators housed in a single conductive housing and an arrangement to shift an operating band of the filter by a one-time adjustment, each resonator including an inner conductor, a bottom and a wall belonging to said housing and a cavity formed in said housing, wherein said arrangement comprises for each resonator an adjustment circuit with a fixed tuning element that is located in the resonator cavity and has an electromagnetic coupling to the inner conductor of the resonator, and an adjusting part located outside said housing, the fixed tuning element and the adjusting part forming a transmission line together with an outer surface of the resonator wall, the electric length of the transmission line being adjusted by a control of the adjustment circuit to change the reactance of the transmission line and thereby the natural frequency of the resonator, and wherein said control is applied in common for all of the resonators of the filter in order to implement said one-time adjustment in shifting the operating band of the filter.

2. A filter according to claim 1, wherein the fixed tuning element is galvanically insulated from conductive surfaces bounding the resonator cavity.

3. A filter according to claim 1, wherein the fixed tuning element is in galvanic contact with said bottom of the resonator.

4. A filter according to claim 1, wherein the adjusting part comprises:

a conductor pattern arranged between a first connecting point connected to the fixed tuning element and a second connecting point; and a plurality of switches, wherein said control is operable to operate one or more of the plurality switches to change the length of the conductor pattern between the first point and the second point in order to change the electric length of said transmission line.

5. A filter according to claim 1, wherein the adjusting part comprises a dielectric adjusting piece and a rigid conductor connected to the fixed tuning element, wherein a straight portion of the rigid conductor runs though the dielectric adjusting piece, and said control is arranged to affect the adjusting piece in order to slide it along the rigid conductor to change the electric length of said transmission line.

6. A filter according to claim 1, the adjusting part being covered by a protective sheet to shield the adjustment circuit against external interference fields and to prevent the adjusting part from radiating to the environment.

7. A filter according to claim 1, wherein each resonator is a quarter-wave coaxial resonator.

8. An adjustable resonator filter, which comprises:

a plurality of resonators housed in a single; conductive housing and an arrangement to shift an operating band of the filter by a one-time adjustment;

wherein each resonator is a half-wave dielectric cavity resonator comprising a bottom and a wall belongina to said housing, a cavity formed in said housing and an inner dielectric piece in the cavity, and wherein said arrangement comprises for each resonator an adjustment circuit with a fixed tuning element that is located in the resonator cavity and has an electromagnetic coupling to said dielectric piece, and an adjusting part located outside said housing, the fixed tuning element and the adjusting part forming a transmission line together with an outer surface of the resonator wall, the electric length of the transmission line being adjusted by a control of the adjustment circuit to change the reactance of the transmission line and thereby the natural frequency of the resonator, and wherein said control is applied in common for all the resonators of the filter in order to implement said one-time adjustment in shifting the operating band of the filter.

9. A filter according to claim 4, wherein the adjusting part further comprises a circuit board on which the conductor pattern is applied and the switches are mounted.

10. A filter according to claim 4, said switches being of the MEMS type.

11. A filter according to claim 5, wherein, in order to implement said common control, the dielectric adjusting pieces of the resonators are mechanically connected to each other by a control rod outside the filter housing.

12. A filter according to claim 11, said control rod being arranged to be moved electrically by an actuator.

* * * * *